US010675489B2

(12) United States Patent
Cheung

(10) Patent No.: US 10,675,489 B2
(45) Date of Patent: Jun. 9, 2020

(54) AIR PURIFIER HAVING AN ELECTRET MODULE

(71) Applicant: ADC Tech International Ltd., Kowloon (HK)

(72) Inventor: William S. H. Cheung, London (GB)

(73) Assignee: DC TECH INTERNATIONAL LTD., Hong Kong (HK)

( * ) Notice: Subject to any disclaimer, the term of this patent is extended or adjusted under 35 U.S.C. 154(b) by 210 days.

(21) Appl. No.: 15/915,319

(22) Filed: Mar. 8, 2018

(65) Prior Publication Data

US 2018/0193678 A1 Jul. 12, 2018

Related U.S. Application Data

(63) Continuation of application No. 14/004,284, filed as application No. PCT/US2012/028548 on Mar. 9, 2012, now Pat. No. 9,913,998.

(Continued)

(51) Int. Cl.
*A62B 23/02* (2006.01)
*B03C 3/30* (2006.01)

(Continued)

(52) U.S. Cl.
CPC ..... *A62B 23/025* (2013.01); *A62B 18/084* (2013.01); *B03C 3/28* (2013.01);

(Continued)

(58) Field of Classification Search
CPC ..... A62B 23/00; A62B 23/02; A62B 23/025; A62B 23/06; A62B 18/02; A62B 18/025; A62B 18/08; A62B 7/10; A62B 19/00; A61M 16/06; A61M 16/105; A61M 16/1055; A61M 16/107; A61M 2202/20; A61M 2202/203; A61M 2202/206; A61M 2205/0272; A61M 2205/0283; A41D 13/11; A41D 13/1153; A41D 13/1192; B03C 3/28; B03C 3/30; B03C 3/32; B03C 3/363; B03C 3/365; B01D 46/0032; B01D 2239/0435

(Continued)

(56) References Cited

U.S. PATENT DOCUMENTS 4,215,682 A 8/1980 Kubik et al.
4,883,052 A 11/1989 Weiss et al.

(Continued)

FOREIGN PATENT DOCUMENTS

WO 2010-078569 7/2010

OTHER PUBLICATIONS

Longo et al., Core-Shell Hydrogel Particles Harvest, Concentrate and Preserve Labile Low Abundance Biomarkers, PLos ONE, Mar. 10, 2009, vol. 4, No. 3.

(Continued)

*Primary Examiner* — Joseph D. Boecker
(74) *Attorney, Agent, or Firm* — The Belles Group, P.C.

(57) ABSTRACT

An air purifier having an electret module for capturing airborne particles, the electret module includes an electret element which generates a static field for capturing airborne particles. The electret module is positioned incorporated into the air purifier such that the static field helps prevent the inhalation of the airborne particles.

9 Claims, 9 Drawing Sheets

Related U.S. Application Data

(60) Provisional application No. 61/451,389, filed on Mar. 10, 2011.

(51) Int. Cl.

| | |
|---|---|
| ***B03C 3/32*** | (2006.01) |
| ***B03C 3/36*** | (2006.01) |
| ***A62B 18/08*** | (2006.01) |
| ***B03C 3/28*** | (2006.01) |
| ***B03C 3/38*** | (2006.01) |

(52) U.S. Cl.
CPC ..... *B03C 3/30* (2013.01); *B03C 3/32* (2013.01); *B03C 3/363* (2013.01); *B03C 3/383* (2013.01)

(58) Field of Classification Search
USPC ..... 128/200.24, 201.25, 203.29, 205.27, 128/205.29, 206.12, 206.17; 96/15, 74; 55/DIG. 39
See application file for complete search history.

(56) References Cited

U.S. PATENT DOCUMENTS

| | | | | |
|---|---|---|---|---|
| 5,206,061 | A | 4/1993 | Ando et al. | |
| 5,468,488 | A * | 11/1995 | Wahi | A62B 23/06 424/78.03 |
| 5,500,038 | A | 3/1996 | Dauber et al. | |
| 5,593,482 | A | 1/1997 | Dauber et al. | |
| 5,706,804 | A | 1/1998 | Baumann et al. | |
| 5,964,221 | A | 10/1999 | McKenna | |
| 6,041,782 | A | 3/2000 | Angadjivand et al. | |
| 6,240,968 | B1 | 6/2001 | Bigonzi-Jaker et al. | |
| 6,306,491 | B1 | 10/2001 | Kram et al. | |
| 6,331,223 | B1 | 12/2001 | Wylie et al. | |
| 6,395,073 | B1 | 5/2002 | Dauber | |
| 6,416,184 | B1 | 7/2002 | Arai et al. | |
| 6,543,450 | B1 | 4/2003 | Flynn | |
| 6,763,835 | B1 | 7/2004 | Grove et al. | |
| 6,914,773 | B2 | 7/2005 | Yang et al. | |
| 6,923,182 | B2 | 8/2005 | Angadjivand et al. | |
| 6,986,804 | B2 | 1/2006 | Dominiak et al. | |
| 7,035,422 | B1 | 4/2006 | Wiener | |
| 8,568,503 | B2 | 10/2013 | Sasaki et al. | |
| 2003/0090842 | A1 | 5/2003 | Smith | |
| 2003/0136408 | A1 * | 7/2003 | Henley | A62B 23/025 128/205.29 |
| 2004/0031490 | A1 | 2/2004 | Haaga | |
| 2004/0105070 | A1 | 6/2004 | Hockaday et al. | |
| 2004/0226448 | A1 * | 11/2004 | Griffiths | B03C 3/14 96/67 |
| 2005/0112655 | A1 | 5/2005 | Banerjee et al. | |
| 2005/0161046 | A1 * | 7/2005 | Michaels | A62B 23/06 128/206.14 |
| 2006/0032371 | A1 * | 2/2006 | Dauber | B01D 46/0032 95/90 |
| 2008/0305101 | A1 | 12/2008 | Ruoslahti et al. | |
| 2009/0054115 | A1 | 2/2009 | Horrdin et al. | |
| 2010/0055435 | A1 | 3/2010 | Neubert | |
| 2010/0087749 | A1 | 4/2010 | Tovey | |
| 2010/0139655 | A1 | 6/2010 | Genosar et al. | |
| 2010/0254914 | A1 | 10/2010 | Park et al. | |
| 2010/0272668 | A1 | 10/2010 | Matsushita et al. | |
| 2011/0041237 | A1 | 2/2011 | Gupta | |
| 2011/0088143 | A1 | 4/2011 | Lee | |
| 2011/0191941 | A1 | 8/2011 | Chiang et al. | |
| 2012/0097037 | A1 * | 4/2012 | Matsuda | B01D 39/1623 96/75 |
| 2014/0190492 | A1 | 7/2014 | Noh et al. | |

OTHER PUBLICATIONS

Sunroad Products; retrieved from https://web.archive.org/web/20090516063220/http://www.sunroadnara.co.jp/product/denshakubou/index.html with date May 16, 2009 (Googe translation to English language).

Toray Fine Chemicals Co., Ltd., TORAYMICRON®, http://www.torayfinechemicals.com/english/products/kino/kin_001.html.

Sencadas, V., R. Gregorio Filho, and S. Lanceros-Mendez. "Processing and characterization of a novel nonporous poly(vinylidene fluoride) films in the 13 phase." Journal of Non-Crystalline Solids 352.21 (2006): 2226-2229.

Wikipedia, "Polyvinyl chloride"; retrieved from https://en.wikipedia.org/wiki/Polyvinyl_chloride.

Holscot Fluoroplastics Ltd., "FEP", retrieved from http://holscot.com/glossary/fep/.

Holscot Fluoroplastics Ltd., "PVDF", retrieved from http://holscot.com/glossary/pvdf/.

Lastique, "Polyvinyl Chloride (PVC)", retrieved from https://web.archive.org/web/20040712081219/http:l/lastique.com/PVC.htm with date Jul. 12, 2004.

WikiHow, "How to Remove Stickers from a Laptop", retrived from https://web.archive.org/web/20081011040119/http://www.wikihow.com/Remove-Stickers-from-a-Laptop with date Oct. 11, 2008.

* cited by examiner

AIR PURIFIER HAVING AN ELECTRET MODULE

CROSS REFERENCE TO RELATED APPLICATIONS

Priority is claimed as continuation application to U.S. patent application Ser. No. 14/004,284, filed Nov. 19, 2013, which claims priority as a national stage application, under 35 U.S.C. § 371, to PCT/US2012/028548, filed Mar. 9, 2012, which claims priority to U.S. provisional application 61/451,389, filed Mar. 10, 2011. The disclosures of the aforementioned priority applications are incorporated herein by reference in their entirety.

FIELD OF THE INVENTION

The field of the present invention is air purifiers, particularly air purifiers that capture airborne particles using electret modules.

BACKGROUND OF THE INVENTION

During the course of a day, an average person takes in approximately 500 milliliters of air per breath. For each breath taken, a person can inhale numerous types of airborne particles, including dust, pollen, mold spores, bacteria, etc. These particles consist of particulate matter in the form of microscopic solids and liquid droplets. This matter can potentially carry harmful diseases, causing irritation, allergic reactions, and disease. Types of diseases which are carried by airborne particles include tuberculosis, chickenpox, measles, and influenza.

The size of airborne particles is related to their potential harm. Smaller particles, for example, those less than 10 micrometers in diameter, are known to cause the greatest harm. These particles can migrate into a person's lungs and bloodstream, potentially affecting vital organs.

Conventional methods of preventing the inhalation of airborne particles are often limited by particle size. Mesh filters worn over a person's mouth, for example, prevent inhalation of large airborne particles. These larger particles, however, are merely irritants and generally will not have a long-term impact on health. While conventional filters can function well for their intended purpose, they generally are not effective in preventing the inhalation of smaller airborne particles. The inhalation of smaller airborne particles, particularly those that are less than 10 microns is, therefore, still a concern.

SUMMARY OF THE INVENTION

The present invention is directed toward air purifiers, particularly air purifiers that capture airborne particles, using electret modules. The electret module emits an electret field that allows the purifier to capture airborne particles.

In a first separate aspect of the invention, an electret module includes an electret element disposed within a housing and an adhesive layer coupled to the housing to capture airborne particles. In general terms, electrets are materials known to emit a quasi-permanent static charge.

One or more optional configuration features may be incorporated into the air purifier, either singly or in combination. In one optional configuration, the air purifier may include a filter that a user can place over their nose and/or mouth. In another optional configuration, the air purifier may include headgear coupled to the electret module.

In a second separate aspect of the invention, the surface potential of an electret element may be restored back to its initial level or further increased using a static restorer. The static restorer includes a battery, a high voltage generator, a rectifier and a smoothing filter. Once applied, the surface potential of the electret element should be restored back to its original potential, or even higher.

Accordingly, an improved air purifier is disclosed. Advantages of the improvements will appear from the drawings and the description of the preferred embodiment.

BRIEF DESCRIPTION OF THE DRAWINGS

In the drawings, wherein like reference numerals refer to similar components.

DETAILED DESCRIPTION

Figure 1:
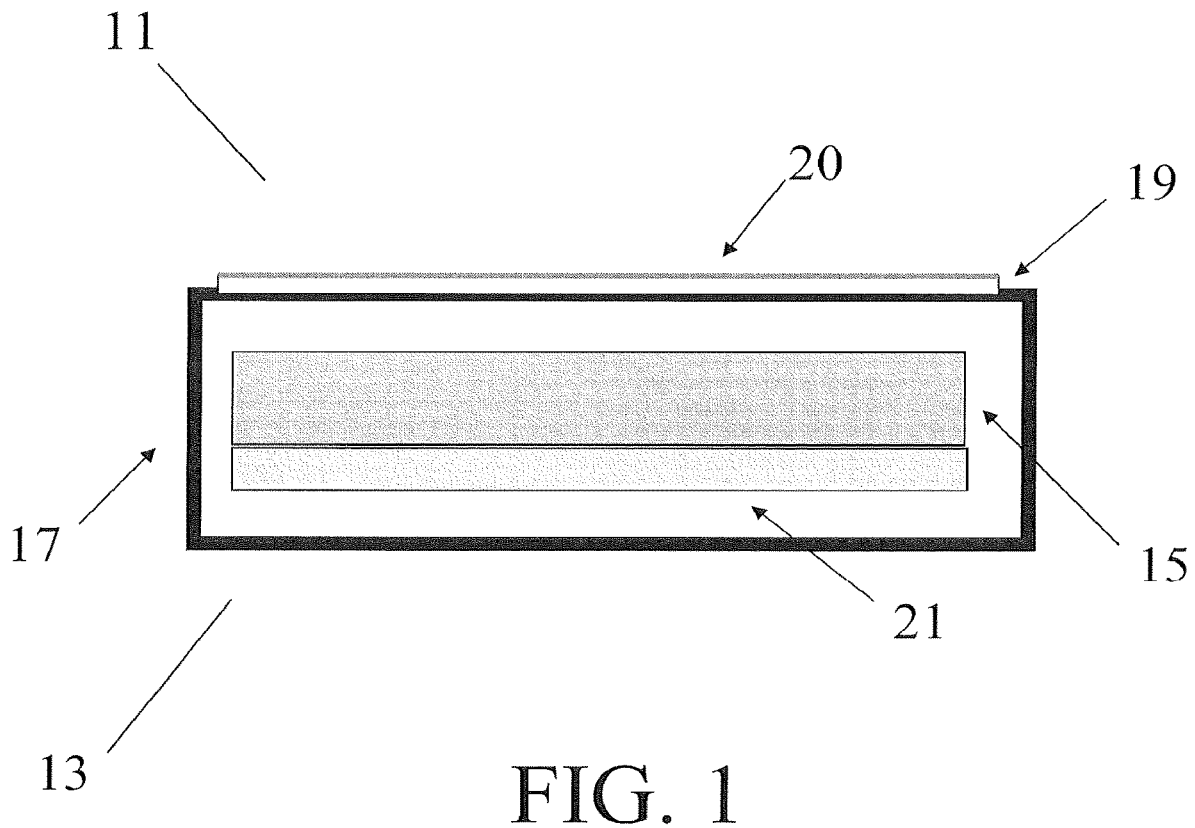
FIG. 1 schematically illustrates an air purifier shown as an electret module.

Turning in detail to the drawings, FIG. 1 illustrates an air purifier 11 formed from an electret module 13. The electret module 13 includes an electret element 15 disposed within a housing 17.

Figure 8:
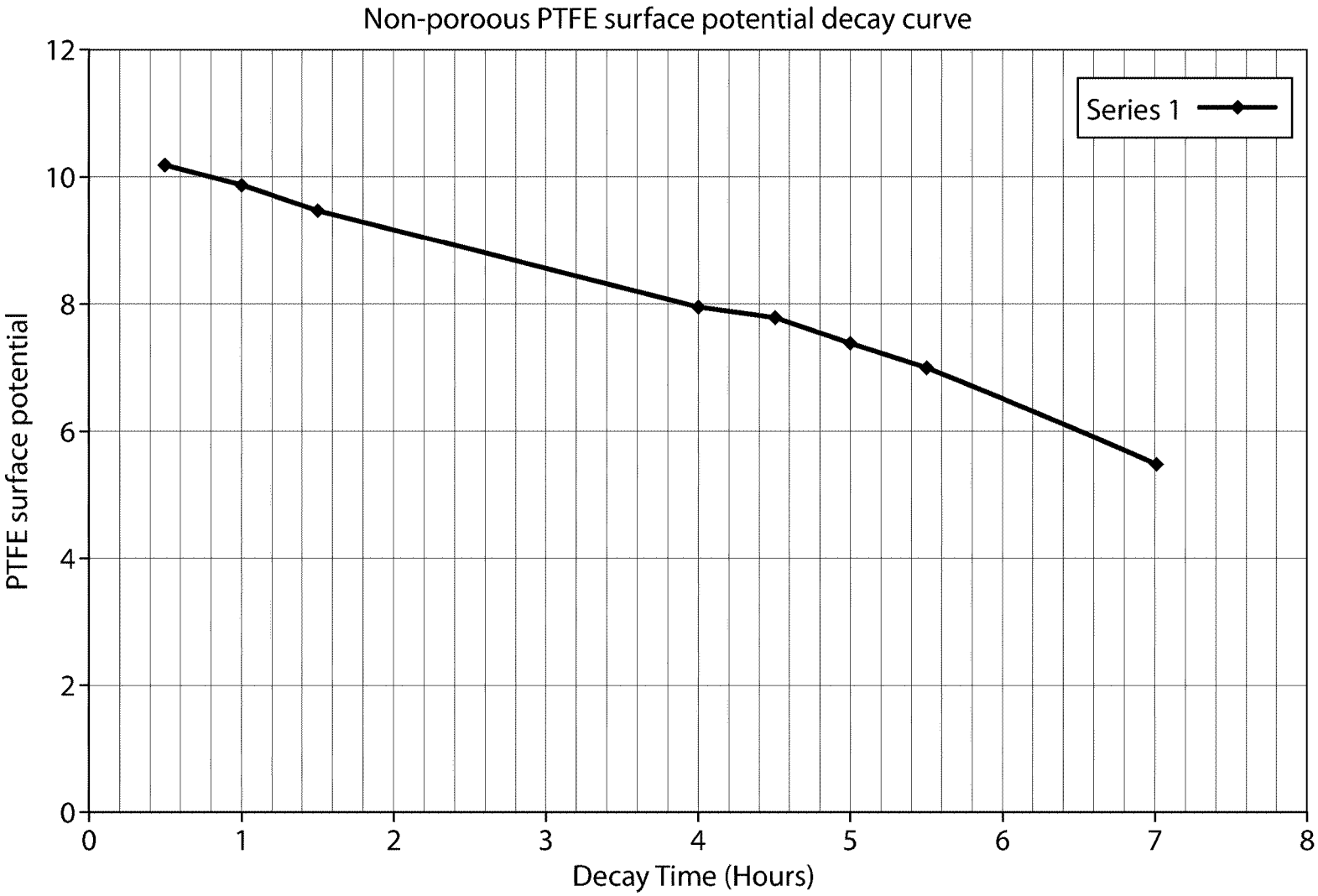
FIG. 8 is a graph illustrating the surface potential decay curve of an electret element after exposure to air.

The electret element 15 may be constructed from synthetic polymers, including fluoropolymers, polyolefins, polyesters, and the like. In one configuration, the electret element 15 is constructed from a non-porous polytetrafluoroethylene (PTFE) film. Other suitable materials may include polypropylene and ethylene terephthalate. Non-porous PTFE is one type of suitable material because of its ability to achieve a high surface potential, using thin film configurations. Non-porous PTFE, however, is known to be affected by its environment, particularly humid conditions and surrounding electric fields. The surface potential of non-porous PTFE may also be unstable and have a faster rate of a surface potential decay, in comparison to other fluoropolymer materials. FIG. 8, for example, shows a surface potential decay curve of non-porous PTFE after exposure to air.

Before being placed into the housing, the electret element 15 is charged. One method for charging the electret element is the corona discharge method. Any effective charging method, however, may be used. In optional configurations, after charging, the surface potential of the electret element can range from 2 KV to 5 KV. This range allows for the electret module to capture small airborne particles. Airborne particles contemplated and their approximate size ranges, in microns, include:

Pollens: 10-1000

Bacteria: 0.300-60

Smoke: 0.010-4

Viruses: 0.005-0.300

Because air is known to carry ionic particles and liquid droplets that may affect the surface potential of some types of electret elements, the electret element 15 is contained within a housing 17. Materials with low attenuation factors, like polyvinylchloride, are preferred as housing materials. These types of housing materials are used to prevent moisture and ionic particles from contacting the electret element 15.

An adhesive layer 19 is disposed on the housing. In one configuration, the adhesive layer is made from a synthetic polymer like polyvinylchloride (PVC) sheet material. Preferably, this layer is detachable. The layer 19 uses an adhesive 20 that is suitable for capturing small airborne particles of the size ranges indicated above. The layer 19 is also attached to the housing 17 using an adhesive or other suitable method.

As shown, the electret module 13 includes a ground layer 21 made from metal, such as a metal foil, or another conductive material. This ground layer is an optional layer, and may be omitted from the electret module depending upon design considerations.

Figure 2:
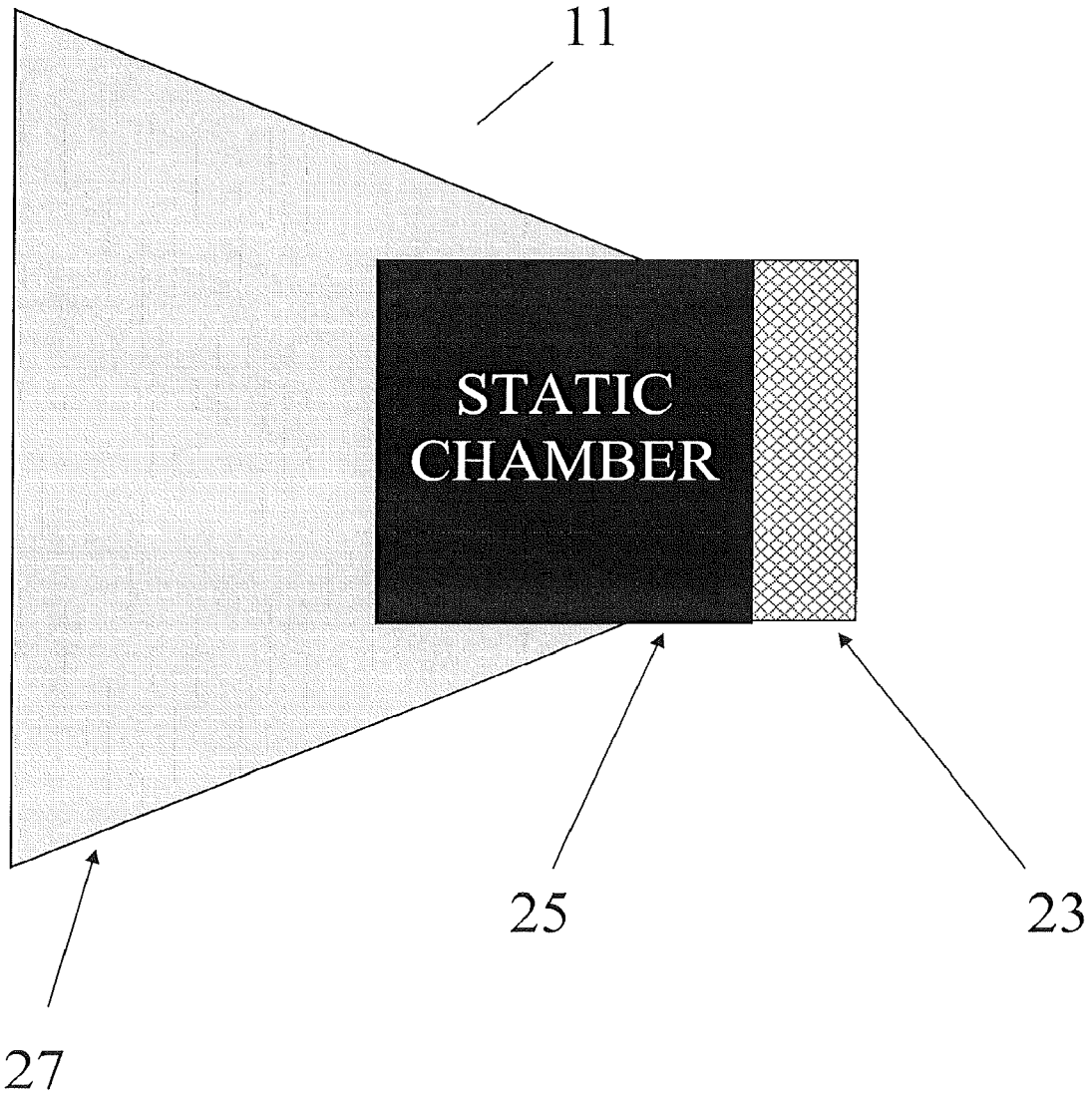
FIG. 2 schematically illustrates an air purifier.
Figure 3:
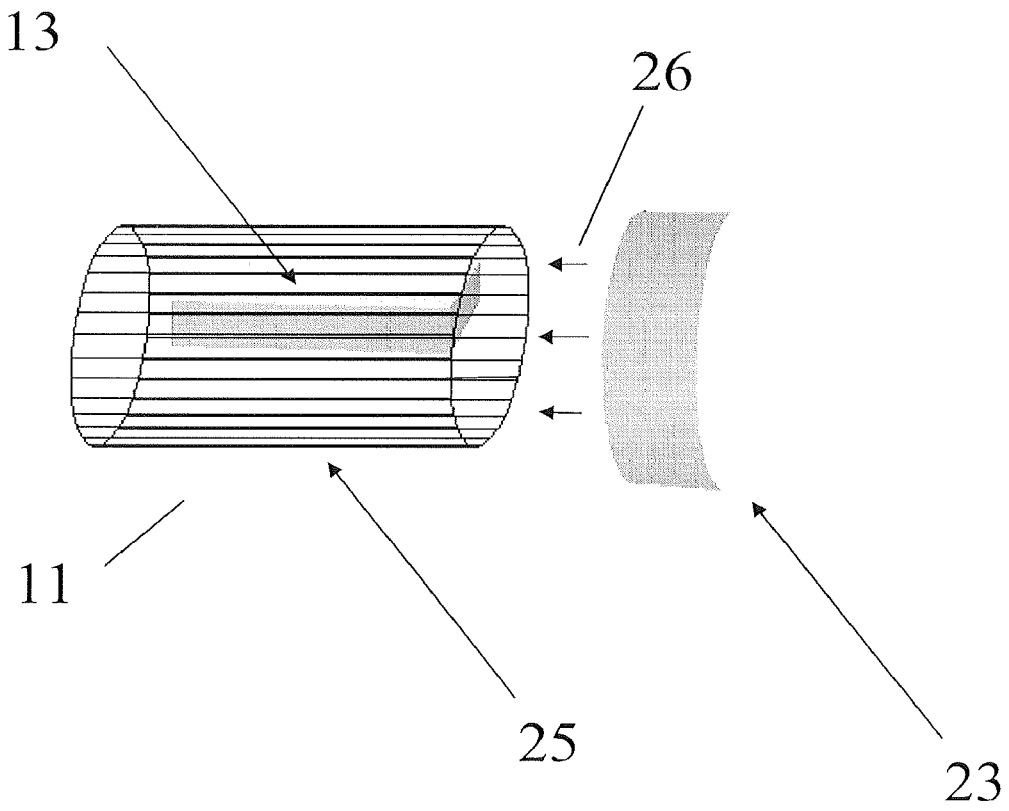
FIG. 3 schematically illustrates an air purifier.
Figure 4:
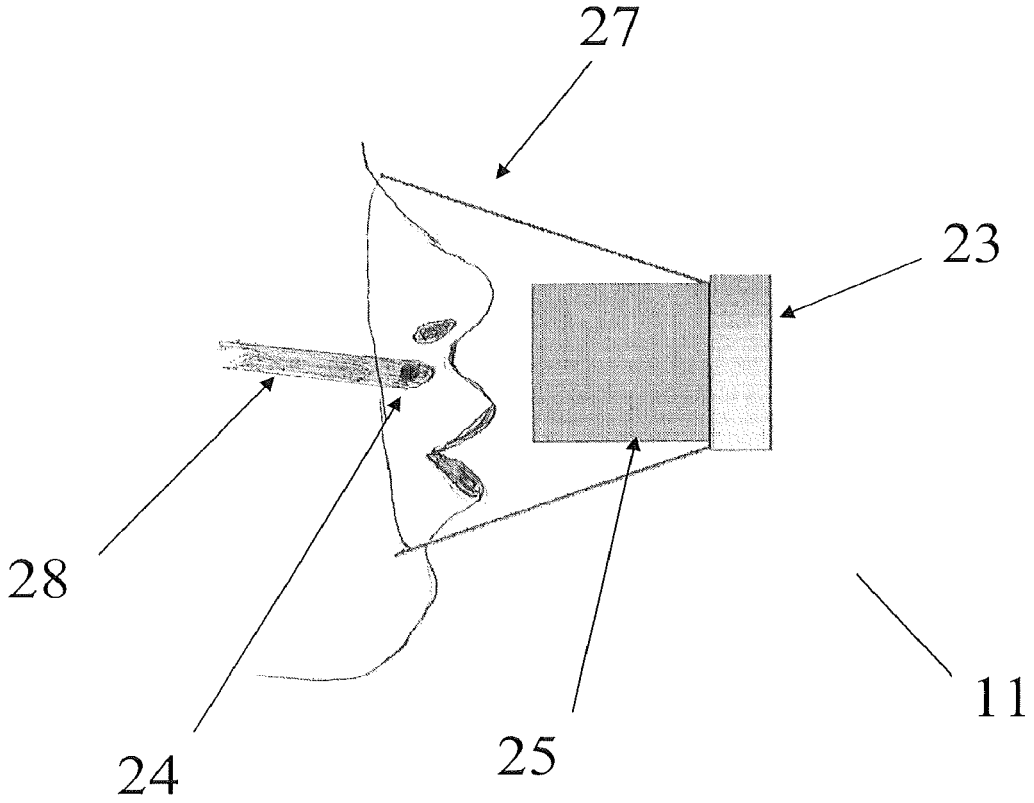
FIG. 4 illustrates a user wearing a air purifier.

In one optional configuration, as shown in FIGS. 2-4, the air purifier includes a filter 23 and a static chamber 25. The filter is made from any suitable mesh material that allows for sufficient filtration of larger airborne particles, i.e. those larger than 10 microns. In FIG. 2, an air purifier 11 having a mask 27, a static chamber 25, and a filter 23 is shown. In this configuration, the static chamber 25 is adjacent to the filter 23 and disposed within the mask 27. The mask may be made from plastic or other soft materials that allow for comfortable placement over a user's mouth and/or nose.

In FIG. 3, an electret module is shown disposed within the static chamber 25 along an air flow path 26. In this configuration, the filter 23 is adjacent to the electret element and in line with the air flow path 26. FIG. 4 illustrates a user wearing a mask 27 that incorporates the static chamber 25 and the filter 23. In this configuration, at least one strap 28 is used to hold the mask 27 securely over a user's mouth and/or nose. The strap is attached to the mask, using a pin 24 or other suitable method of attachment. The strap may be made from plastic or other soft materials that allow for comfortable placement on a user's mouth and/or nose. Optionally, the strap 28 is elastic and adapted to extend over a user's head, ears, and/or neck.

Figure 5:
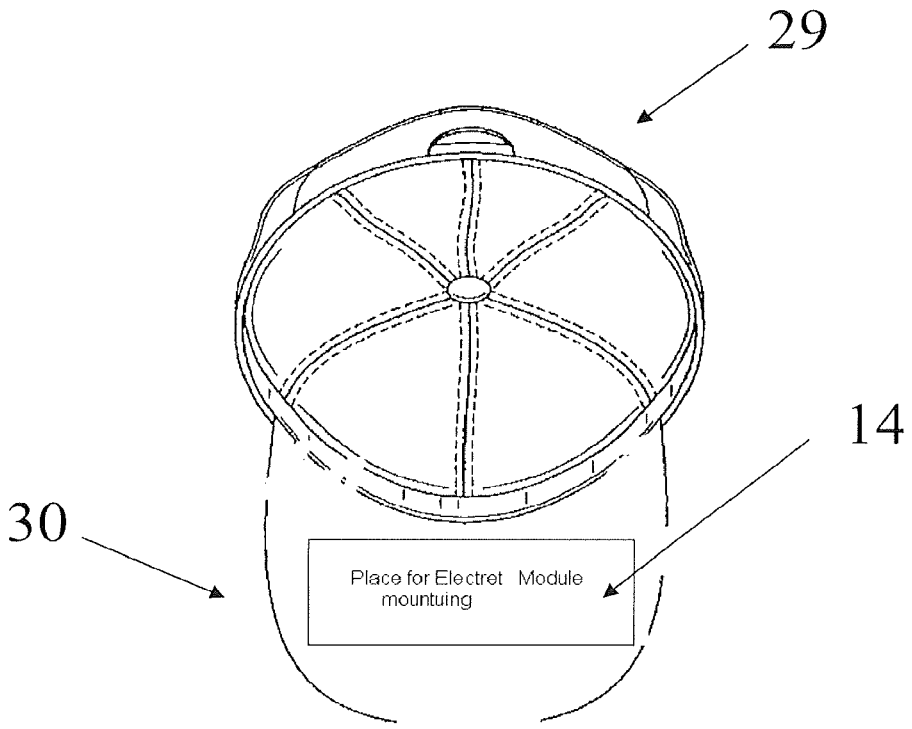
FIG. 5 illustrates an electret module attached to headgear.
Figure 6:
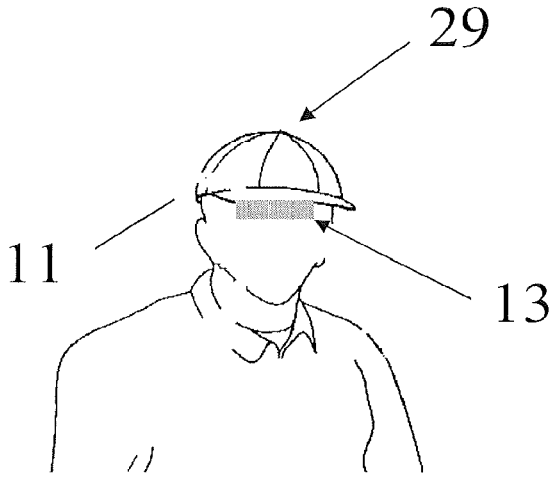
FIG. 6 illustrates an air purifier incorporated into headgear.

As shown in FIGS. 5 and 6, in other optional configurations, the air purifier includes an electret module coupled to headgear 29. Although shown as a cap, the electret module may be coupled to any type of headgear or other gear that is close enough to a person's eyes, mouth and/or nose to capture airborne particles. In FIG. 5, a module area 14 where an electret module may be coupled to a cap brim 30 is shown. In this configuration, the electret module can generate a static field (not shown) towards the face of a person.

Figure 7:
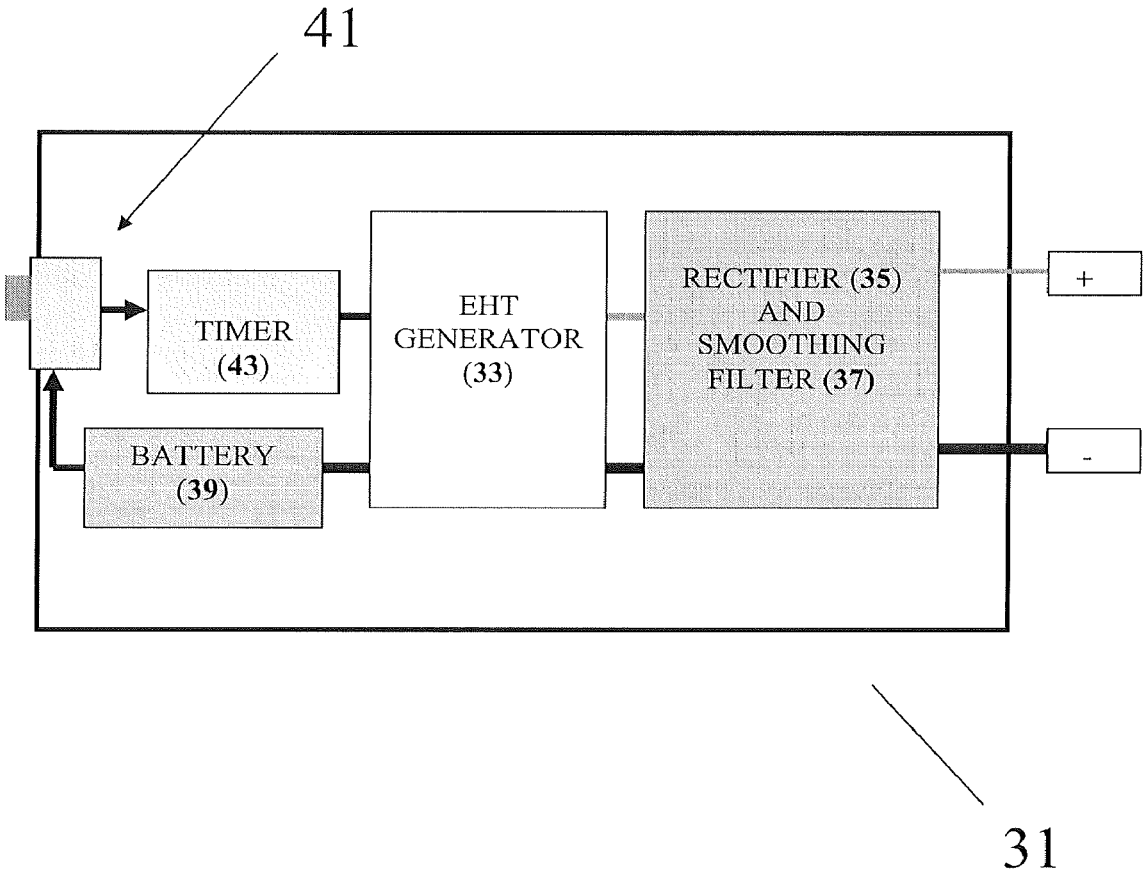
FIG. 7 schematically illustrates a static restorer.

FIG. 7 shows a block diagram, illustrating a static restorer 31. The static restorer 31 increases the surface potential of an electret element. The static restorer 31 uses a high voltage field potential to force the internal molecular dipole to realign with the applied field. After realignment of the C-F bond by the external field, the internal molecular polarities increase the surface potential of the electret element.

The static restorer 31 includes a high voltage generator 33, also referred to in the art as an extra high tension (EHT) generator. The static restorer also includes an AC to DC rectifier 35, a smoothing filter 37, a battery 39, and a switch 41. The high voltage generator 33 is made using a low frequency oscillator and a voltage step-up transformer (not shown). Optionally, the high voltage generator includes a timer 43 to control the duration of EHT output.

Without the application of the static restorer, the surface potential of an electret element can decay, as shown in FIG. 8. In one example, a sample electret element was made from non-porous PTFE. The electret element initially had a surface potential of 11.5 KV. The electret element was then exposed to air for 6.5 hours. After this exposure, the surface potential was measured at 5.5 KV.

Figure 9:
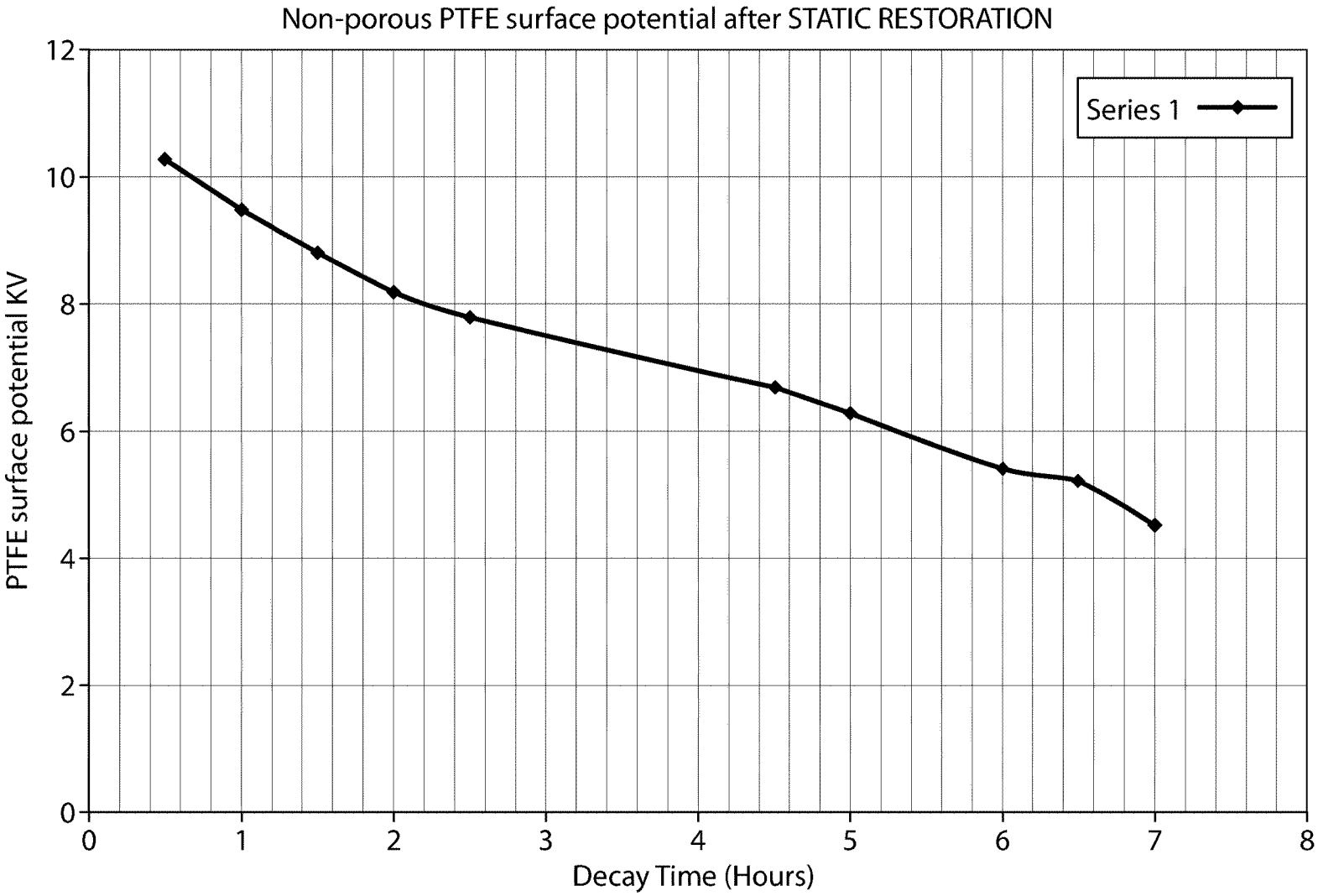
FIG. 9 is a graph illustrating the surface potential decay curve after application of the static restorer.

Using this same sample electret element, a static restorer having a 20 KV output was applied for 5 minutes. After this application, the surface potential increased to 10.5 KV. The sample electret element was then exposed to air for 5.6 hours. Afterwards, the surface potential decreased to 4.3 KV. A graphical representation of this decay is shown in FIG. 9.

Accordingly, air purifiers having electret modules and a static restorer are disclosed. While aspects of this invention have been shown and described, it will be apparent to those skilled in the art that many more modifications are possible without departing from the inventive concepts herein. The invention, therefore, is not to be restricted except in the spirit of the following claims.

What is claimed is:

1. An air purifier comprising:

a face mask configured to fit over at least one of a nose and a mouth of a user, the face mask comprising a static chamber and a large particle filter, wherein an air flow path is formed through both of the static chamber and the large particle filter an electret module configured to capture airborne particles, the electret module comprising an electret element comprising a non-porous film, the electret module being affixed to the static chamber and positioned in the air flow path, such that the electret element generates a static field within the static chamber for capturing airborne particles.

2. The air purifier of claim 1, the electret module further comprising:

a housing enclosing an interior space, the electret element located within the interior space; and an adhesive layer coupled to an exterior of the housing.

3. The air purifier of claim 2, wherein the housing is polyvinylchloride.

4. The air purifier of claim 1, wherein the adhesive layer comprises polyvinylchloride.

5. The air purifier of claim 1, wherein the electret element is a fluoropolymer.

6. The air purifier of claim 1, wherein the electret element is non-porous polytetrafluoroethylene.

7. The air purifier of claim 1, further comprising a conductive layer, the electret element coupled to the conductive layer.

8. The air purifier of claim 1, wherein the large particle filter comprises a mesh material positioned across the air flow path.

9. The air purifier of claim 1, wherein the large particle filter is configured to filter particles larger than 10 microns from air passing through the air flow path.

* * * * *